United States Patent [19]

Matsushita et al.

[11] Patent Number: 4,566,383

[45] Date of Patent: Jan. 28, 1986

[54] WINDING APPARATUS FOR REMOVING USED STENCIL

[75] Inventors: Ken Matsushita; Tetsuo Onishi, both of Wakayama, Japan

[73] Assignees: Duplo Seiko Corporation, Wakayama; Duplo Manufacturing Corporation, Tokyo, both of Japan

[21] Appl. No.: 642,164

[22] Filed: Aug. 20, 1984

[51] Int. Cl.[4] ..... B41L 13/08

[52] U.S. Cl. ..... 101/121

[58] Field of Search ..... 101/114, 116, 117, 118, 101/121, 122, 129; 242/192, 59, 68.7, 78.7

[56] References Cited

U.S. PATENT DOCUMENTS

| | | | |
|---|---|---|---|
| 3,957,220 | 5/1976 | Beck et al. | 242/59 X |
| 3,991,955 | 11/1976 | Crayton | 242/192 |
| 4,034,928 | 7/1977 | McDonald et al. | 242/59 |
| 4,134,338 | 1/1979 | Selman | 101/122 |
| 4,404,902 | 9/1983 | Horii et al. | 101/122 |
| 4,434,948 | 3/1984 | Feldkamper | 242/59 |

*Primary Examiner*—J. Reed Fisher

*Attorney, Agent, or Firm*—Burns, Doane, Swecker & Mathis

[57] ABSTRACT

A winding apparatus for removing a used stencil in a printing machine having a stencil lift-off mechanism for lifting the leading end of the used stencil from a printing drum assembly and transporting mechanism for transporting the used stencil onto the winding apparatus, the winding apparatus comprises a generally cylindrical floating core for taking up the used stencil therearound, a support mechanism for rotatably supporting the core in contact directly therewith or through the used stencil when the core is at least partially wound with the used stencil, and a drive mechanism for rotating the core about the longitudinal axis thereof at a speed synchronized with the speed of transport of the used stencil.

7 Claims, 6 Drawing Figures

WINDING APPARATUS FOR REMOVING USED STENCIL

BACKGROUND OF THE INVENTION

1. Field of the Invention

The present invention generally relates to a rotary printing machine of a type using a stencil and, more particularly, to a winding apparatus in the printing machine for removing a used stencil attached on a printing drum assembly of the printing machine, such as a rotary mimeographic printing machine.

2. Description of the Prior Art

Conventionally, there have been known apparatuses used for the printing machine which are capable of removing a used stencil automatically without using operator's hands.

In U.S. Pat. No. 4,134,338, there is proposed an apparatus, as is shown schematically in FIG. 4, in which a used stencil 1 separated from a printing drum assembly is inserted in a gap between two gears 2, 3 meshed with each other, and the stencil crumpled by two gears 2, 3 is then thrown into a waste box 4. This apparatus, however, has some disadvantages in that the number of the used stencil in the apparatus can throw into the waste box 4 is limited to a relatively small number, since the used stencil thrown into the waste box 4 as crumpled by the gears 2 and 3 is rather bulky. Furthermore, when an operator wishes to detach said box from the printing machine in order to dispose the used stencils contained therein, some of the used stencils are forced out from a take-in aperture and cause staining the hands or clothes of the operator.

On the contrary to the above, there is proposed in the Japanese Laid-Open Patent Publication No. 95185/1984 an apparatus which is provided, as shown in FIG. 5(*a*), with a pair of generally fork-like winding arms 7 oppositely disposed on respective sides of a used stencil 6 having a leading end reinforced with a cardboard strip 5. When the used stencil 6 is to be removed, the pair of winding arms 7 are forwarded so as to receive both sides of the cardboard strip 5 of the used stencil into the fork-like portions 7*a* as indicated by the arrows Ar1 in FIG. 5(*a*) and, are then, rotated about their longitudinal axis, as indicated by an arrow Ar2, to wind the rest portion of the used stencil into a roll-like form. After that, the used stencil having been wound is dropped into a waste box 8 as shown in FIG. 5(*b*).

Although the apparatus of this type has an advantage in that the number of the used stencils being accommodated in the box 8 is increased, it has some disadvantages that it requires the use of a specially designed stencil as mentioned above and in that the apparatus tends to be rather complicated since it needs a special mechanism for moving and rotating the pair of the winding arms.

SUMMARY OF THE INVENTION

The present invention has been developed with a view to substantially removing the above described disadvantages and has for its essential object to provide an apparatus which is capable of winding an increased number of used stencils around one common disposable core.

Another object of the present invention is to provide an apparatus having a structure which is capable of supporting the winding core in a floating manner.

A still another object of the present invention is to provide an apparatus which is capable of disposing the used stencils without staining the hands or clothes of an operator.

According to the present invention, there is provided a winding apparatus for removing a used stencil in a printing machine, such as a mimeographic printing machine, having means which is capable of lifting the leading end of the used stencil from a printing drum assembly in the printing machine, and means for transporting the used stencil into the winding apparatus which comprised a generally cylindrical, disposable floating core for taking up the used stencil therearound and a support means for supporting the core in contact therewith. The supporting means contacts the core through the used stencil when the used stencil is at least partially wound around the core. A drive means is also used to rotate the core about the longitudinal axis thereof at a speed substantially synchronized with the speed of transport of the used stencil.

BRIEF DESCRIPTION OF THE DRAWINGS

These and other objects and features of the present invention will become apparent from the following description taken in conjunction with a preferred embodiment thereof with reference to the accompanying drawings, in which like parts are designated by like reference numerals, and in which:

FIG. 5(*b*) is a schematical view showing a waste box for the used stencils having been taken up according to the apparatus shown in FIG. 5(*a*).

DESCRIPTION OF THE PREFERRED EMBODIMENTS

Figure 1:
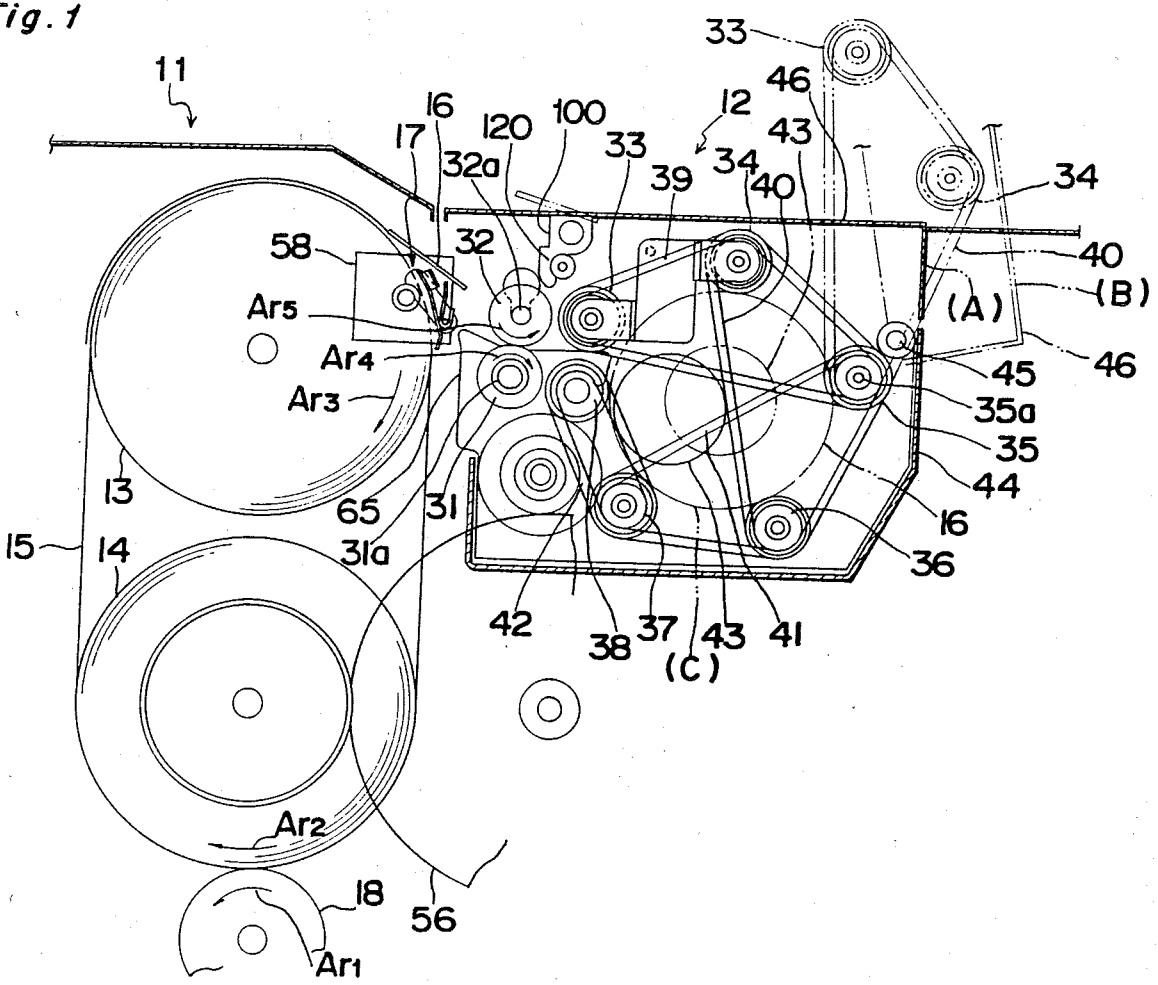
FIG. 1 is a schematical sectional view of a winding apparatus according to an embodiment of the present invention.

FIG. 1 shows an embodiment according to the present invention applied to a rotary mimeographic printing machine.

As shown in FIG. 1, the printing machine 11 is provided with a winding apparatus 12 according to the present invention.

The printing machine 11 has rotary drums 13 and 14, a screen 15 trained between said two drums 13 and 14, a clamp means 17 for attaching a stencil 16 on a screen 15, and a pressure roller 18 contacting intermittently the drum 14 through the screen 15 and the stencil 16.

When a paper to be printed is fed between the pressure roller 18 and the stencil 16 attached on the screen 15 travelling in a clockwise direction as indicated by the arrow Ar2, then the pressure roller 18 is contacted with the screen 15 and printing ink fed to the stencil 16 through the screen 15 is transferred on the paper as is well known to those skilled in the art.

Figure 2:
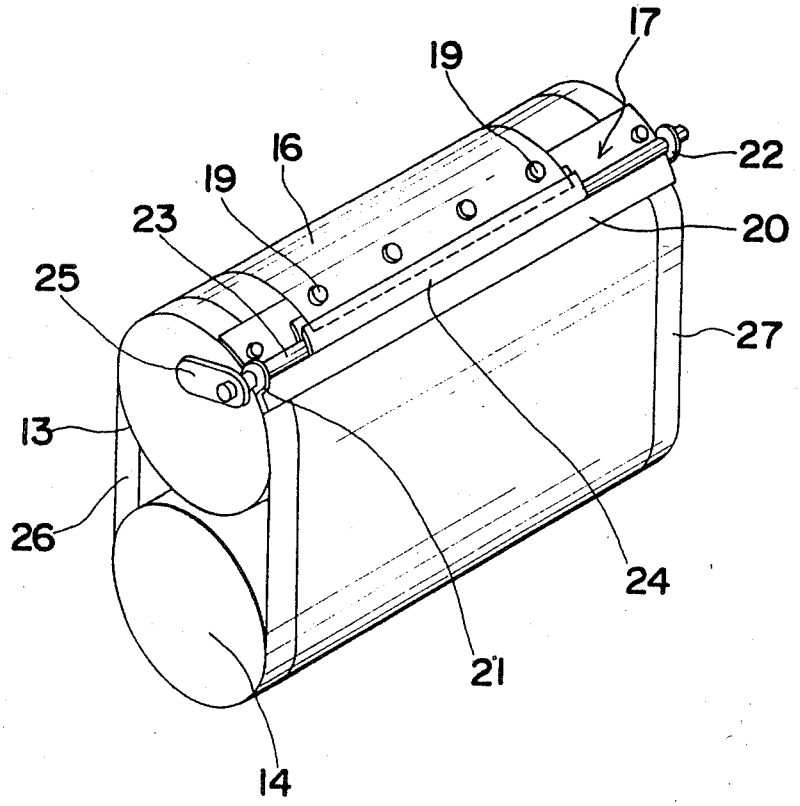
FIG. 2 is a perspective view showing a printing drum assembly in a mimeographic printing machine.

As shown in FIG. 2, a clamp means 17 is provided which comprises a plate member 20 elongated in a direction parallel to the axis of the drum 13. The plate member 20 has a plurality of protuberances 19 engageable in a plurality of small apertures defined in the leading end portion of the stencil 16. The clamp means also comprises a shaft 23 rotatably supported by bearings 21, 22 which are provided at respective ends of the plate member 20, a clamp member 24 having a slit through which the leading end of the stencil 16 is inserted. The clamp member 24 is fixedly supported by the shaft 23 and is biased by a spring means (not shown) so as to resiliently contact to the plate member 20, and a lever member 25 for releasing the leading end of the stencil 16 is fixed at one end of the shaft 24.

The plate member 20 is so fixed on belts 26 and 27, provided on respective side edges of the screen 15, as to make the stencil 16 move together with the screen 15, trained between the drums 13 and 14, without any sliding movement relative to the drums 13 and 14.

The leading end portion of the stencil 16 is inserted into the slit of the clamp member 24 to avoid disengagement thereof from the protuberances 19 of the plate member 20 during the printing operation.

As shown in FIG. 1, the winding apparatus 12 comprises transport rollers 31 and 32 for transporting a used stencil 16 from the printing machine 11 onto the winding apparatus 12, first to sixth rollers 33, 34, 35, 36, 37 and 38, a first endless member 39 trained among the first, second and third rollers 33, 34 and 35, a second endless member 40 trained among the second, third and fourth rollers 34, 35 and 36, a third endless member 41 trained among the third, fourth and fifth rollers 35, 36 and 37, a fourth endless member 42 trained between the fifth and sixth rollers 37 and 38, a floating winding core 43 supported by inner runs of the first to fourth endless members 39 to 42, and a drive mechanism for driving both of said transport roller 31 and the sixth roller 38 at a speed synchronized with each other.

The transport rollers 31 and 32 are spaced a relatively short distance from the drum 13 and extend in parallel to the axis of the drum 13. A shaft 32*a* of the transport roller 32 is biased by a spring means (not shown) towards the other transport roller 31 maintaining a parallel relation with the shaft 31*a* thereof. Accordingly, the transport roller 32 is rotated in a counterclockwise direction as indicated by the arrow Ar5 in contact with the other roller 31 as the latter is rotated in a clockwise direction as indicated by the arrow Ar4.

The first to sixth rollers 33 to 38 are so disposed and so positioned as to occupy respective apexes of a hexagon on one side of the rollers 31 and 32 opposite to the drum 13. The first and sixth rollers 33 and 38 are disposed near to the transport rollers 32 and 31, respectively, and are spaced such a small distance from each other as to define a take-in gap for the used stencil 16 therebetween.

The core 43 is generally cylindrical and is made of relatively hard paper material such as cardboard or of plastic. The core 43 is designed to have an axial length longer than the width of the stencil 16 so as to accommodate both ends of the core 43 being remained at clean condition even when a much number of the used stencils 16 are wound therearound. In the present embodiment, the axial length of the core 43 is about 310 mm, while the width of the stencil is 270 mm.

The core 43 is supported in a floating fashion with its outer peripheral surface thereof contacting four respective inner runs of the first to the fourth endless members 39, 40, 41 and 42. Each of the endless members 39 to 42 may be a belt made of elastic material or a coiled wire member having its opposite ends connected together. As is clear from FIG. 1, the inscribed circle of space defined by said four inner runs is smaller than the circle defined by the outer peripheral surface of the core 43. Therefore, the four inner runs when supporting the core 43 in the floating fashion as described above is resiliently curved inwardly in contact with the core 43. As a result of this unique support system for the core 43, the core 43 can be rotated in one direction about the axis thereof, as at least one of the first to fourth endless members 39 to 42 is driven to run in one direction. Moreover, the core 43 is floated to an equilibrium position determined by forces applied on the core 43 by said four inner runs, and the equilibrium position shifts as the radius of the core 43 gradually increases with a plurality of used stencils wound therearound.

It is to be noted that each of the first to fourth endless members 39 to 42 may be provided in two although only a single endless member is shown. Where two endless members are used for each of the first to fourth endless members 39 to 42, they should be spaced apart from each other a distance smaller than the width of the stencil.

Each of the first and second rollers 33 and 34 is rotatably supported at both sides by a frame 46 which is hingedly mounted on a base frame 44 of the winding apparatus 12 by a hinge shaft 45. Contrary to the above, the third to sixth rollers 35 to 38 are rotatably supported by the base frame 44.

When a new core is to be installed or a full core with the used stencils wound therearound is to be removed, the frame 46 is, after a hook means 100 has been unlocked from a locking bar member 120, opened from a lock position (A) shown by the solid line to a position (B) indicated by the chain line in FIG. 1.

Figure 3:
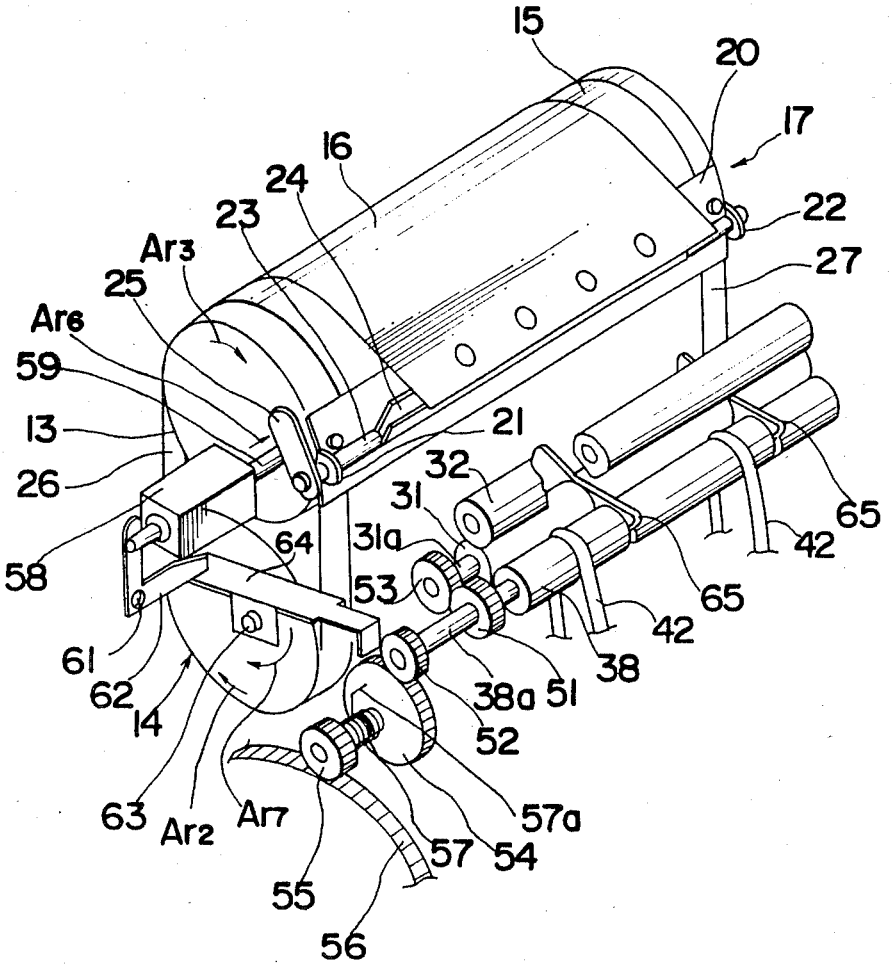
FIG. 3 is a perspective view showing a portion of a driving mechanism of the removing apparatus according to the present invention.
Figure 4:
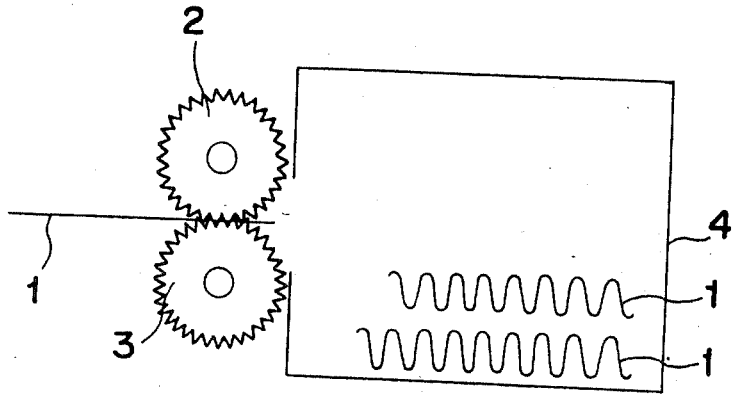
FIG. 4 is a view showing schematically the conventional apparatus for removing used stencils.
Figure 5A:
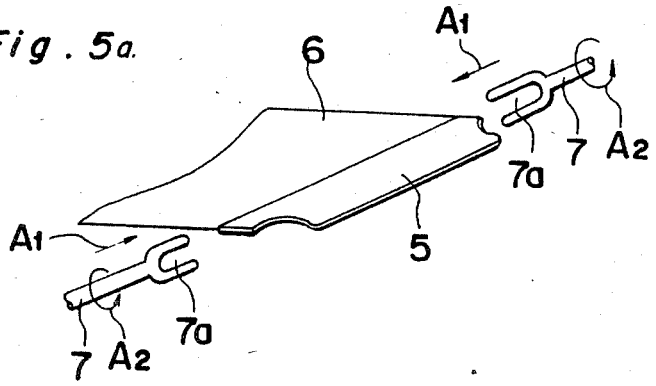
FIG. 5(*a*) is a schematical perspective view showing another conventional apparatus for taking up a used stencil.
Figure 5B:
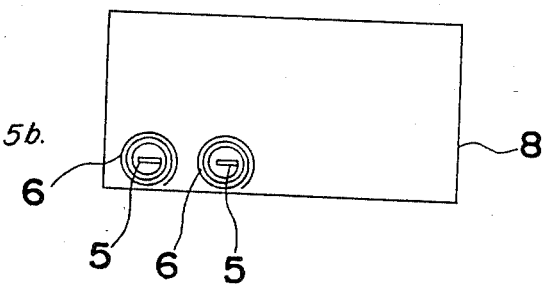

Referring now to FIG. 3, there is shown a drive mechanism for driving the transport roller 31 and the sixth roller 38.

As shown in FIG. 3, the shaft 38*a* of the roller 38 has one end on which two gears 51 and 52 are coaxially and fixedly mounted in spaced from each other. On one end of the shaft 31*a* of the transport roller 31, a gear 53 is so fixedly mounted as to engage the gear 51 on the shaft 38*a*. The other gear 52 of the shaft 38*a* is engaged with an accelerator gear 54 which is driven, via an idler gear 55, by a drive gear 56 provided for driving the drum 14 (See FIG. 1).

There is provided a clutch means 57 utilizing a coiled wire spring for coupling and decoupling between the accelerator gear 54 and the gear 55. This clutch means 57 is so operated by a solenoid means 58 as to rotate said gears 54 and 55 together during the winding of a used stencil 16 by the winding apparatus 12 and as to make said gear 55 freely rotatable disengaged from said accelerator gear 54 during the printing by the printing machine 11.

The solenoid means 58 has a plunger 59 passing through the former in a direction axially thereof. When the solenoid means 58 is energized, the plunger 59 protrudes in a direction indicated by the arrow Ar6 to kick up the lever 25 of the clamp means 17. When said lever 25 is rotated to the position where the plunger 59 has been protruded, the plunger 59 kicks up the free end of the lever 25 of the clamp means 17 by removing of the clamp means 17 with the screen 15 in a direction indicated by the arrow Ar3. Because of this, the lever 25 and the clamp plate 24 are rotated in a clockwise direction, as viewed in FIG. 3, to release the leading end of the used stencil 16. As a result of this, the leading end of the used stencil 16 is lifted from the screen 15 and is moved towards the transport rollers 31 and 32 according to the rotation of the screen 15.

The other end of the plunger 59 is connected to one end of a generally L-shaped lever 62 which is supported by a shaft 61 for pivotal movement in a vertical plane including the axis of the plunger 59. The other end of the lever 62 is held in engagement with one end of a lever 64 which is pivotally supported at its middle portion by a shaft 63 for pivotal movement in a vertical plane substantially orthogonal to said vertical plane for the movement of the lever 62. The lever 64 is biased by a spring (not shown) so as to pivot on the shaft 63 in a direction indicated by the arrow Ar7. The lever 64 has a hook at the other end thereof which is engageable with a bent end 57*a* of said spring clutch means 57. When the solenoid means 58 is energized to lift the leading end of the used stencil 16 and the plunger 59 is moved in the direction Ar6, the lever 64 is rotated with the other end having the hook and the latter is disengaged from the end 57*a* of the clutch means 57, as a result, the clutch means 57 connects the accelerator gear 54 with the gear 55 for rotation together therewith.

As clearly shown in FIG. 3, there is provided a pair of guide plates 65 and 65 for guiding the used stencil 16 towards a gap defined by and between two transport rollers 31 and 32 and, then, towards the take-in gap defined between the first and sixth rollers 33 and 38.

Hereinafter, the operation of the apparatus will be explained referring particularly to FIG. 1 and FIG. 3.

When the printing operation performed by the printing machine 11 is finished, the operator turns on a removing switch (not shown) in order to remove the used stencil 16 from the drum assembly of the printing machine 11. When such switch is turned on, a motor (not shown) is started to rotate the drive gear 56 and, therefore, the drums 13 and 14 of the drum assembly are rotated in the direction Ar3 and Ar2, respectively. At the same time, the solenoid means 58 is energized to move the plunger 59 in the direction Ar6. Because of this, the clutch means 57 is operated to connect the accelerator gear 54 with the gear 55 being driven by the drive gear 56. Therefore, the transport roller 31 and the sixth roller 38 are driven by the driving means mentioned above. Moreover, when the sixth roller 38 is so driven, the fourth endless member 42 trained between the sixth and fifth rollers 38 and 37 travels and, then, the third, the second and the first endless members 41, 40 and 39 are consequently driven to travel around the fifth, the fourth, the third, the second and the first rollers 37, 36, 35, 34 and 33, respectively.

When the clamp means 17 rotating together with the screen 15 passes the position where the plunger 59 is protruded, the lever 25 is kicked up by the plunger 59 to release the used stencil 16 from the clamp means 17. The leading end of the used stencil 16 having been lifted from the screen 15 is guided by guide plates 65 and 65 between the transport rollers 31 and 32.

When the leading end of the used stencil 16 is introduced in between said transport rollers 31 and 32, the transport roller 31 drives the leading end in cooperation with the other transport roller 32 and with the guide plate 65 and 65 towards the take-in gap between the first and sixth rollers 33 and 38.

In the present embodiment, the leading end of the stencil 16 being transported is guided by the guide plate 65 and 65, contacting the first roller 33 and the first endless member 39 trained around the first roller 33 towards the floating core 43. The floating core 43 having been rotated by the first to fourth endless members 39 to 42 takes up the used stencil 16 from the leading end thereof in cooperation with each of the inner runs of the first to fourth endless members 39 to 42.

It is to be noted that the used stencil 16 is tightly wound around the outer periphery of the floating core 43, since all of the inner runs of the first to fourth endless members 39 to 42 contact with the outer peripheral surface of the floating core 43 through the used stencils, if these have been wound, to press the used stencil 16 thereon.

As the number of the used stencils 16 wound around the core increases, the outer radius of the floating core 43 increases and the center thereof is shifted to a point determined by the tensions of the endless members 39 to 42.

The floating core 43 can take up used stencils until the outermost one of the stencils wound around the floating core 43 is brought in contact with the first to sixth rollers 33 to 38 as shown by the phantom line (C) in FIG. 1. According to the present embodiment, it can take up about thirty to forty sheets of the used stencils.

When the winding radius of the floating core 43 has attained a value such that the outermost one of the stencils is likely to contact the rollers 33 to 38, the operator should take out the floating core 43 from the winding apparatus 12 after opening the frame 46 supporting the first and second rollers 33 and 34 to the chain line position (B).

In order to detect that the radius of the core wound with a maximum allowable number of the used stencils has exceeded a predetermined maximum radius, it is desirable that the shaft of one of the first to sixth rollers, for instance, the shaft 35*a* of the third rollers 35, be supported for movement a short distance in a direction away from the floating core 43 and that a micro-switch (not shown) is provided to detect the movement of said shaft.

The number of the rollers for around which the endless members are trained is not limited to that shown and described, but may be four or more. Also, the manner by which the endless members are trained is not limited to that shown and described.

Moreover, the endless members according to the present invention may be non-elastic, such as endless chains, V-belts. In such a case, a tension is applied to each of the endless members by a suitable tensioning roller by supporting resiliently each shaft of the rollers to give a latitude of movement required to keep the inner run of the endless member in contact with the outer peripheral surface of the floating core 43.

From the foregoing description, it has now become clear that the used stencil separated from the printing machine is wound around the disposable core guided by the endless members while the core itself is rotated in contact with the endless members through a turn or turns of the used stencil therearound. Therefore, the winding apparatus according to present invention can be wind up many number of the used stencils around the core. After a predetermined number of the used stencils have been wound around the core and the radius of which has reached the maximum allowable value, the core together with the used stencils wound therearound is easily removed from the winding apparatus for the disposal. Thus, it is clear that even an unskilled operator of the printing machine can remove the core full with the used stencils for the subsequent disposal thereof and, at the same time, the possibility of the operator's hands or clothes becoming stained with printing ink is substantially obviated because both ends of the full core have remained without staining with the printing ink by reason of the axial length of the core being longer than the width of the used stencil.

Moreover, if the core, when taking up the used stencil, is rotated in such a direction, such as in the illustrated embodiment, the surface of the used stencil having the printing ink is wound upon the surface of the core or the wound stencil and the printing ink being interposed between the surfaces, then the printing ink remaining on that surface of the used stencil acts as an adhesive and, therefore, there is no possibility of the turns of the used stencil on the core being loosened to separate therefrom.

Furthermore, because of the novel support and drive system according to present invention constituted by the endless members, the core may not be supported by, or have, a shaft or the like with bearings. Therefore, not only can the winding apparatus be fabricated compact in size, but also it is easy for the operator to install an empty core within the space confined by the endless member and the generation of noise is also minimized in the operation.

Although the present invention has been fully described with reference to the preferred embodiment, many modifications and variations thereof will now be apparent to those skilled in the art, and the scope of the present invention is therefore to be limited not only by the details of the preferred embodiment described above, but also by the terms of the appended claims.

What is claimed is:

1. A winding apparatus for removing a used stencil in a printing machine having means for lifting a leading end of the used stencil from a printing drum assembly in the printing machine and means including a pair of transporting rollers for transporting the used stencil into said winding apparatus, which apparatus comprises:

a generally cylindrical floating core for taking up the used stencil therearound;

support means for rotatably supporting the core in contact therewith, said support means contacting said core through the used stencil when the core is at least partially wound with said used stencil; and said support means including drive means comprising at least first to fourth rollers disposed around the core for rotating the core about a longitudinal axis thereof at a speed substantially synchronized with the speed of transport of the used stencil, said first to fourth rollers cooperating with at least first to third endless spring members in the form of coiled wire members, said first to third endless spring members being entrained between said first and second rollers, said second and third rollers, and said third and fourth rollers, respectively.

2. A winding apparatus according to claim 1, wherein said cylindrical core is a hollow cylinder and made of a light-weight material.

3. A winding apparatus according to claim 2, wherein said light-weight material is cardboard paper.

4. A winding apparatus according to claim 2, wherein said light-weight material is plastics.

5. A winding apparatus according to claim 2, wherein said cylindrical core has a greater length than the width of the used stencil.

6. A winding apparatus according to claim 1 wherein one of the parallel runs of the respective endless spring members adjacent the core is resiliently curved inwardly in contact with the core to drivingly support the core.

7. A winding apparatus according to claim 1, wherein said first and fourth rollers are spaced a predetermined distance from each other so as to define a gap for introducing a leading end of said used stencil onto the core.

* * * * *